US006086472A

United States Patent [19]

Furukawa

[11] Patent Number: 6,086,472

[45] Date of Patent: Jul. 11, 2000

[54] THROW-INTO-TYPE COIN DISCRIMINATOR

[75] Inventor: Tetsuo Furukawa, Iwatsuki, Japan

[73] Assignee: Asahi Seiko Co., Ltd., Tokyo, Japan

[21] Appl. No.: 09/262,160

[22] Filed: Mar. 3, 1999

[30] Foreign Application Priority Data

Mar. 2, 1998 [JP] Japan ..... 10-090552

[51] Int. Cl.[7] ..... G07D 1/00; G07F 1/04

[52] U.S. Cl. ..... 453/3; 453/56; 194/346

[58] Field of Search ..... 194/346; 453/3, 453/4, 7, 11, 56

[56] References Cited

U.S. PATENT DOCUMENTS 4,558,711 12/1985 Yoshiaki et al. .
5,207,611 5/1993 Ueda et al. .

FOREIGN PATENT DOCUMENTS 0481699 4/1992 European Pat. Off. ..... 453/56
9237372 of 1996 Japan .
9319913 5/1996 Japan .

*Primary Examiner*—Robert P. Olszewski
*Assistant Examiner*—Bryan Jaketic
*Attorney, Agent, or Firm*—Quirk & Tratos

[57] ABSTRACT

A throw-in coin discriminator is shown which includes a hopper to receive the coins to be discriminated. From the hopper a conveyor conveys the coins to a coin handling mechanism. A roller unstacks any stacked coins. The unstacked coins are deposited on a second conveyor which is traveling at a faster speed to singularize the coins. The coins pass a series of detectors to determine, for example, whether the coins are genuine or counterfeit. The coin handling mechanism directs authentic coins in a first direction and counterfeit coins in a second direction.

5 Claims, 6 Drawing Sheets

THROW-INTO-TYPE COIN DISCRIMINATOR

FIELD OF THE INVENTION

This invention relates to an apparatus for distinguishing and discriminating coins electronically.

BACKGROUND

In the prior art, various types of throw-into-type coin discriminators have been developed. For example, as disclosed in the specification of Japanese patent application 8-174064 (see Japanese patent disclosure 9-319913) by this applicant. In the throw-into-type coin discriminator as shown in FIG. 6, various kinds or classifications of coins are fed into a hopper 9 which is in the shape of a trumpet. These coins pass through a long hole open in the bottom of the hopper 9 and are conveyed out of the hopper by an endless flat belt. The width of the hole in the bottom of the hopper 9 is formed taking into account the diameter of the largest coin to be handled, for example, a 500 Yen coin. Therefore, the various classifications of coins thrown into the hopper 9 are conveyed in a row. The plurality of coins conveyed in the row is leveled so that there may be no overlap or stacking of coins by an inverse roller 13 which rotates in reverse to the direction of travel of the flat belt. The coins flattened in the row on the conveyer from the hopper 9 are deposited onto another endless flat belt 7. Since this flat belt 7 travels at faster velocity than the first flat belt, the coins which have been flattened or unstacked are conveyed and separated by the second flat belt 7, the coins having been singularized or placed on the belt one by one. Each coin is dropped from the flat belt 7 one by one into the coin selector 20 through the slot hole 27 such that the coins are dropped in a standing up condition, i.e. on edge. The coin drops inside the selector 20 according to its weight and type having previously been judged electronically as hereinafter described.

With continuing reference to FIG. 6, the coin is sent from the selector 20 dropping by its weight as arrives along a long rail 31 in a standing up, on edge condition.

SUMMARY OF THE INVENTION

The invention is developed for the purpose of providing an integration of means to align thrown-into coins, means to distinguish the authenticity and type or classification of the coins, and means to receive an authentic coin and to reject the counterfeit coin. In other words, the invention has a purpose to align different kinds of thrown-into coins, distinguish the authenticity and money type of each coin and reject counterfeit coins while receiving authentic coins.

Toward this end, a coin discriminator apparatus is set forth which includes a housing having at one end a hopper to receive coins. A conveyer is adapted to convey coins from the hopper to a coin handling mechanism. Means are provided to singularize the coins on the conveyer; that is, position them on the conveyer in a row, one by one. Sensors are disposed to sense, for coins as they are conveyed toward the coin handling mechanism, at least one physical aspect of each coin to determine one class of coins from another. For example, the sensors may be adapted to sense the diameter, thickness and material of composition of the coins as they are conveyed. At the coin handling mechanism, a coin determined to be of one class, e.g. authentic, is directed in a first direction, and a coin determined to be of another class, e.g. counterfeit, is directed in a second direction. For example, a coin determined to authentic would be directed into the selector 20 (FIG. 6) for sorting or further discrimination.

BRIEF DESCRIPTION OF THE DRAWINGS

These and other features and advantages will become appreciated as the same becomes better understood with reference to the specification, claims and drawings wherein:

DESCRIPTION

Turning to the drawings, the throw-into-type coin discriminator is shown. The main body of the discriminator is large and is formed in the shape of a long box. On the left of the long box shape, a hopper 11, which may be U-shaped is provided. The coins to be discriminated are thrown into the hopper 11. An endless belt 12 at the bottom of the hopper 11 has a large width and is tensioned at the bottom of the hopper 11. As shown on the drawings, the thrown-into-coins are conveyed rightwardly. While the details of the belt 12 are not shown, it is to be understood that it is rotated by a motor 11 which can rotate in forward and reverse directions.

Figure 1:
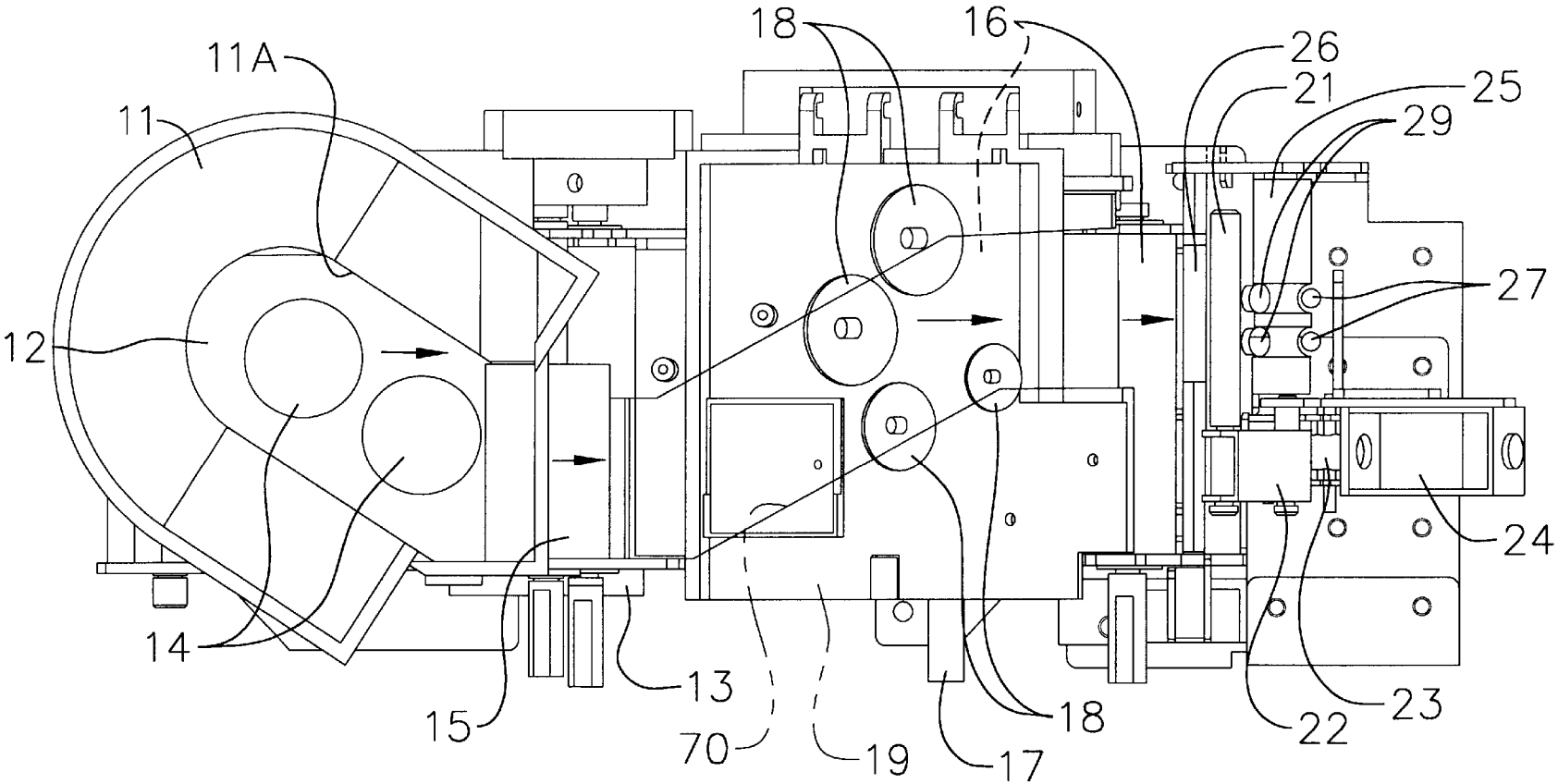
FIG. 1 is a plan view of one embodiment of the apparatus according to the present invention.
Figure 2:
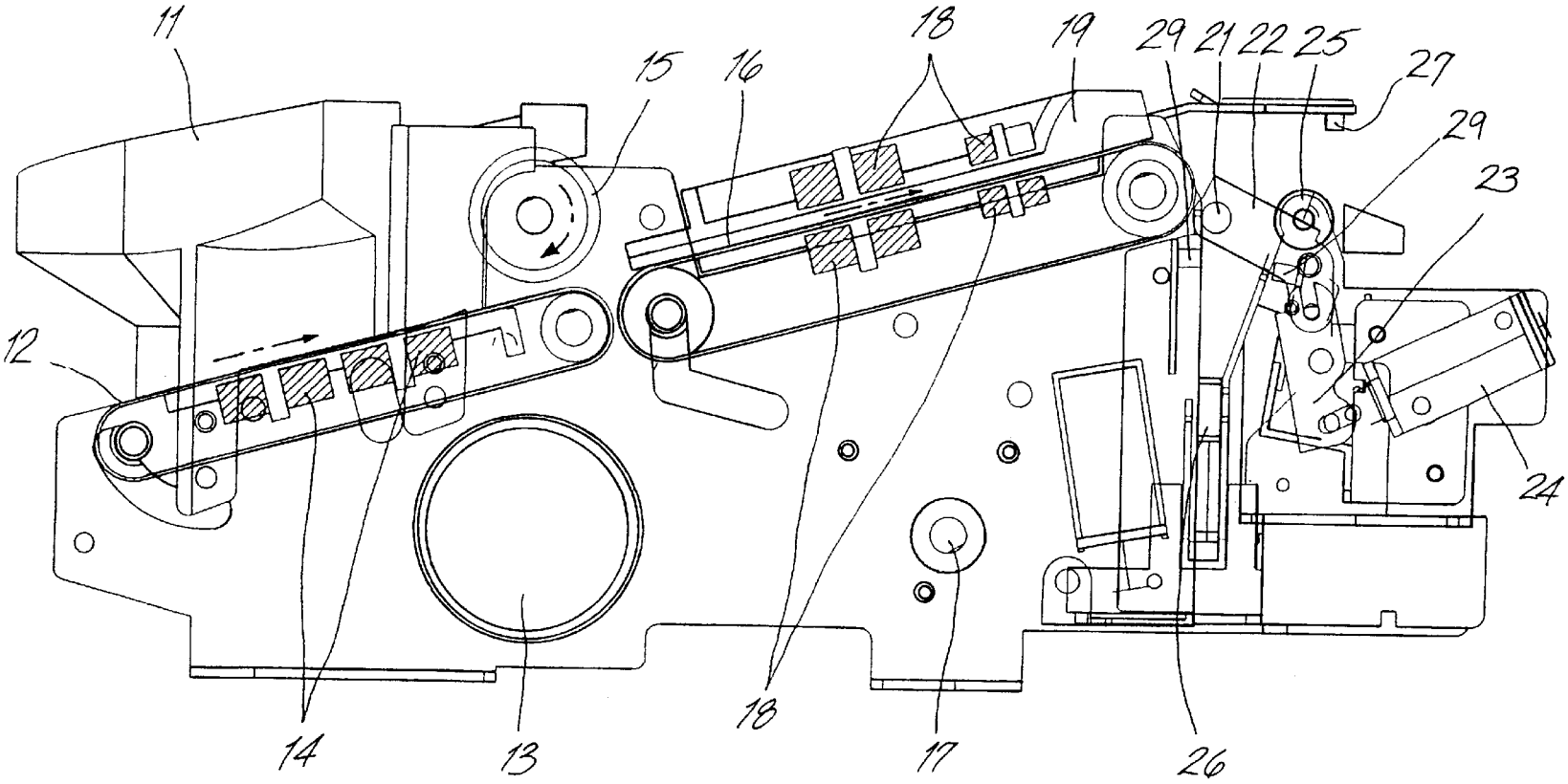
FIG. 2 is a front section view of FIG. 1.

Two sensors 14 for coin or metal are arranged under the coin conveying surface of the belt 12 as shown in FIGS. 1 and 2. That is, if a coin is thrown into the hopper 11, any one of the two sensors 14 will detect the coin and will output a start signal to the motor 13. The motor 13 starts as a result of the start signal and as a result the belt 12 is actuated and the coins will be conveyed rightwardly as shown in the drawings from the hopper 11. The edge 11A of the lower opening of the hopper 11 forms a guide which is slanted to the travel direction of the belt 12 and aligns the coins in a row as a result.

On the upper part of the coin discriminator, i.e. on the right end of the belt 12 (FIGS. 1 and 2) a reverse roller 15 is provided. The roller 15 unstacks and breaks down overlapping coins on the belt 12 and puts the coins in a row in sheet form on the belt 12.

Near the right side upper part of the coin discriminator near the right end of the belt 12, an endless second belt 16 having a large width is tensioned and the coins are conveyed rightwardly thereby as shown in the drawings. The second belt 16 is rotated normally by a motor 17 the details of which have been omitted herein. The belt velocity of the second belt 16 is faster than the velocity of the belt 12. As a result, the coins which where in a row and sheet on belt 12 are singularized and separated onto the second belt 16 to be arranged one by one.

Under the coin conveying surface of the second belt 16 on one side a discriminator, sensors 18 are arranged in four locations. On the other side of the discriminator sensors 18 are arranged in a like fashion in a cover 19 for the second belt 16 as shown in FIGS. 1 and 2. These four discriminating sensors 18 are for distinguishing the diameter, thickness and two kinds of materials or two metals of the coins being conveyed.

To direct the coins on the second belt 16 to the sensors 18, a diagonal reference line 70 is formed on the upper surface of the second belt 16. The reference line 70 guides the coins on the second belt 16 as they approach the discriminating sensors 18. The reference line 70 provides a staggered groove (not shown) for example, on the interior of the cover to direct and align the coins to direct and align the coins to pass for sensing by the sensors 18.

Near the right end of the second belt 16, a long and slender selection roller 21 is provided. This selection roller 21 is operated by whether the coin is genuine or counterfeit. It is operated to discriminate the coins by a solenoid 24 and a pivot arm 22 for a pivot length 23. The selection roller 21 need not be a roller and may be in any other form which can guide an authentic coin in a first direction. At the right hand side of the selection roller 21 a small, thick sending roller 25 is arranged. The sending roller 25 sends out a genuine coin from the right hand side to the selector 20. If the coin is determined to be counterfeit, the second roller 25 becomes a stop body.

Figure 5:
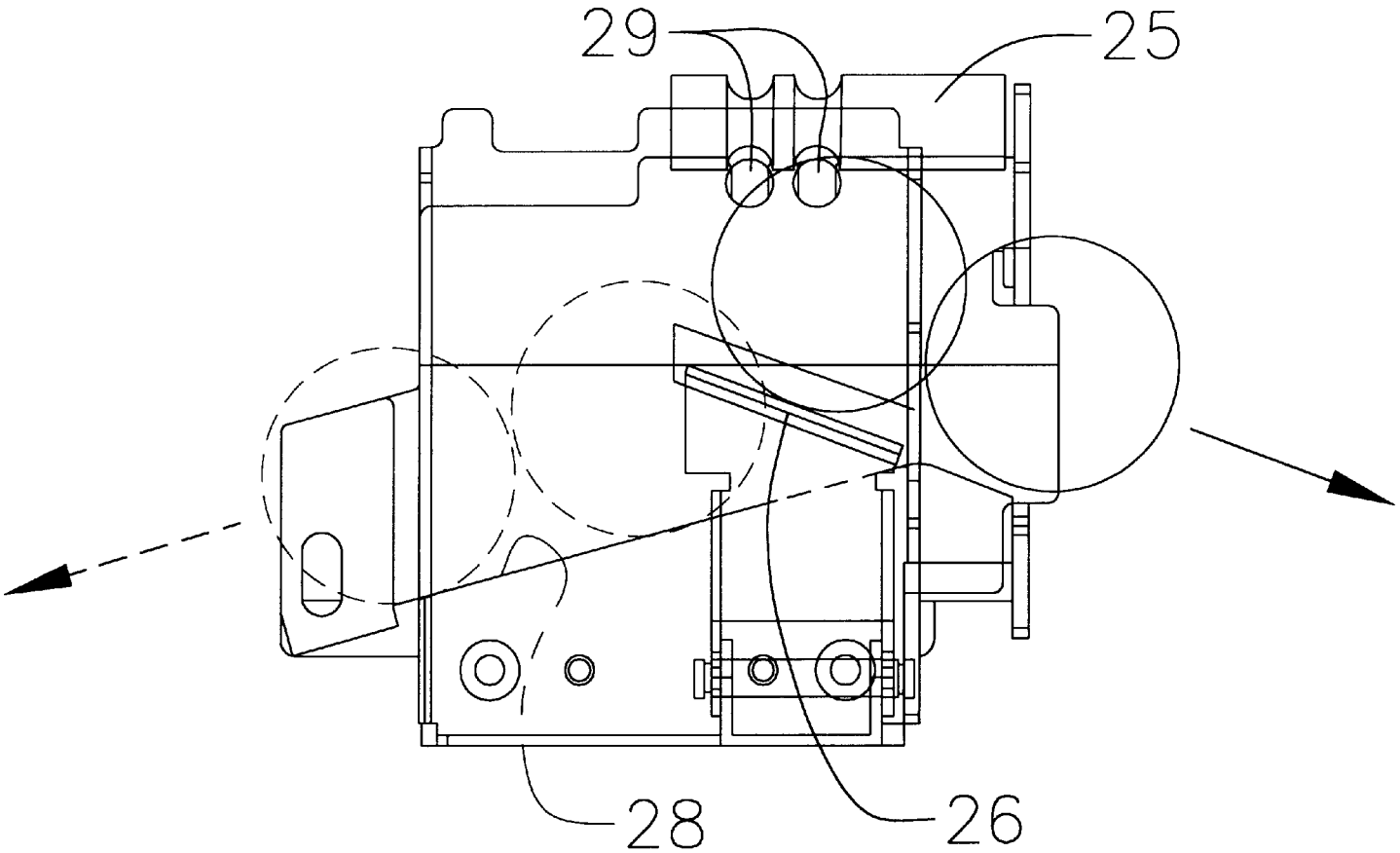
FIG. 5 is a right side view of the apparatus of FIG. 4.
Figure 6:
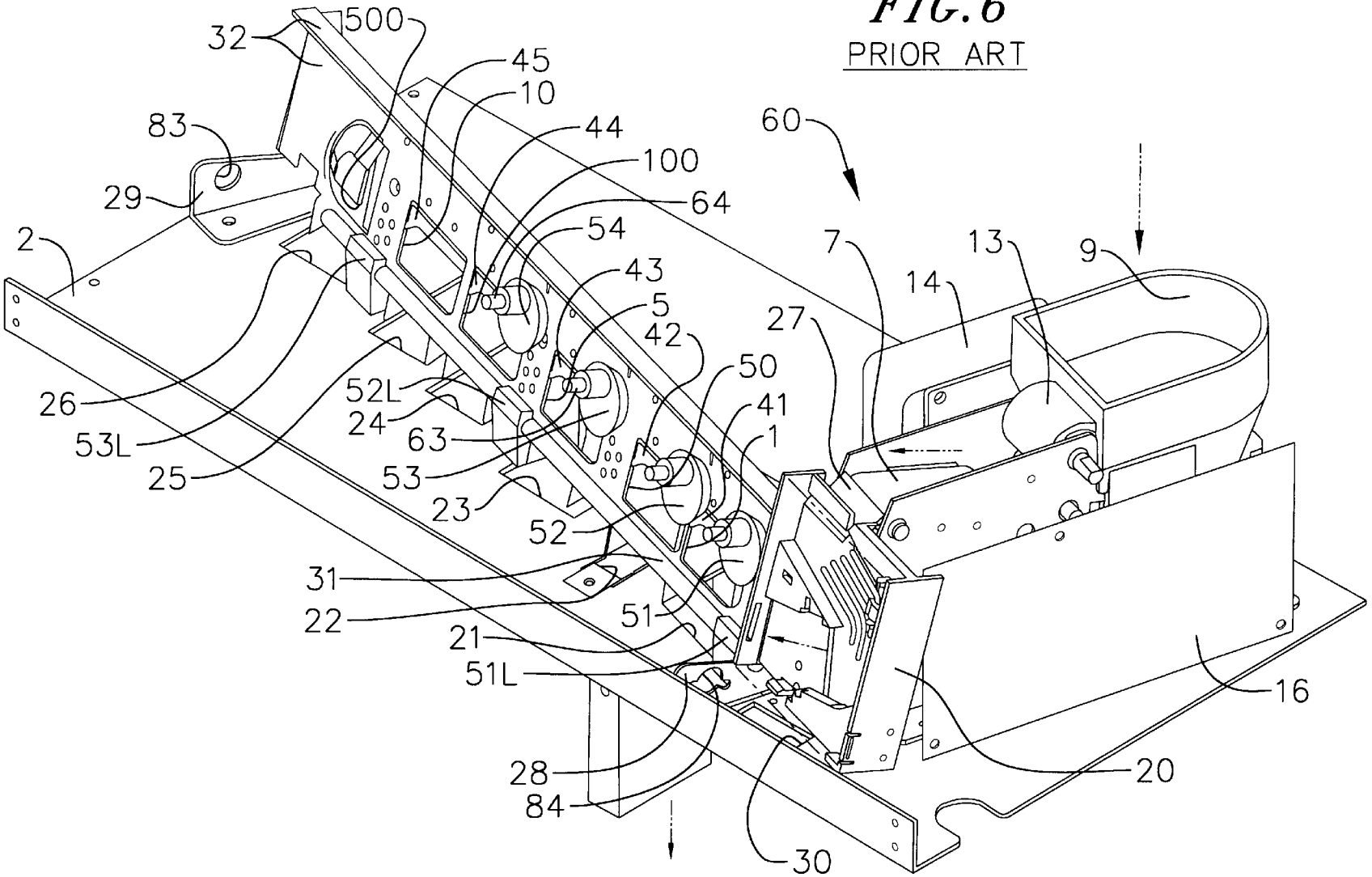
FIG. 6 PRIOR ART
FIG. 6 is an overall view of a prior art device incorporating a prior art discriminating device.

Disposed under the selection roller 21 is a rejection board 26 (FIG. 5) which is diagonally arranged. The rejection board 26 is usually projected as shown on the drawings and is drawn into the apparatus by a solenoid (not shown) when it is required to direct a rejected, counterfeit coin.

Additionally, at the upper and lower positions near the sending roller 25 are two sets of sensors 27 for detecting the passage of an authentic coin. The two sets of sensors 29 for detecting the passage of a counterfeit coin are arranged at the right and left positions under the sending roller 25. The sensors 27 and 29 have two sets, respectively. Therefore, a passage of a perforated coin, for example, a 5 Yen coin or a 50 Yen coin, is detected correctly by means of two light output beams of the sensors 27 and 29. In other words, in the case of perforated coins, since two pulses may be outputted by the sensors 27 and 29, this can be compensated with another beam.

The operation of the discriminator according to the present invention will now be described.

Figure 3:
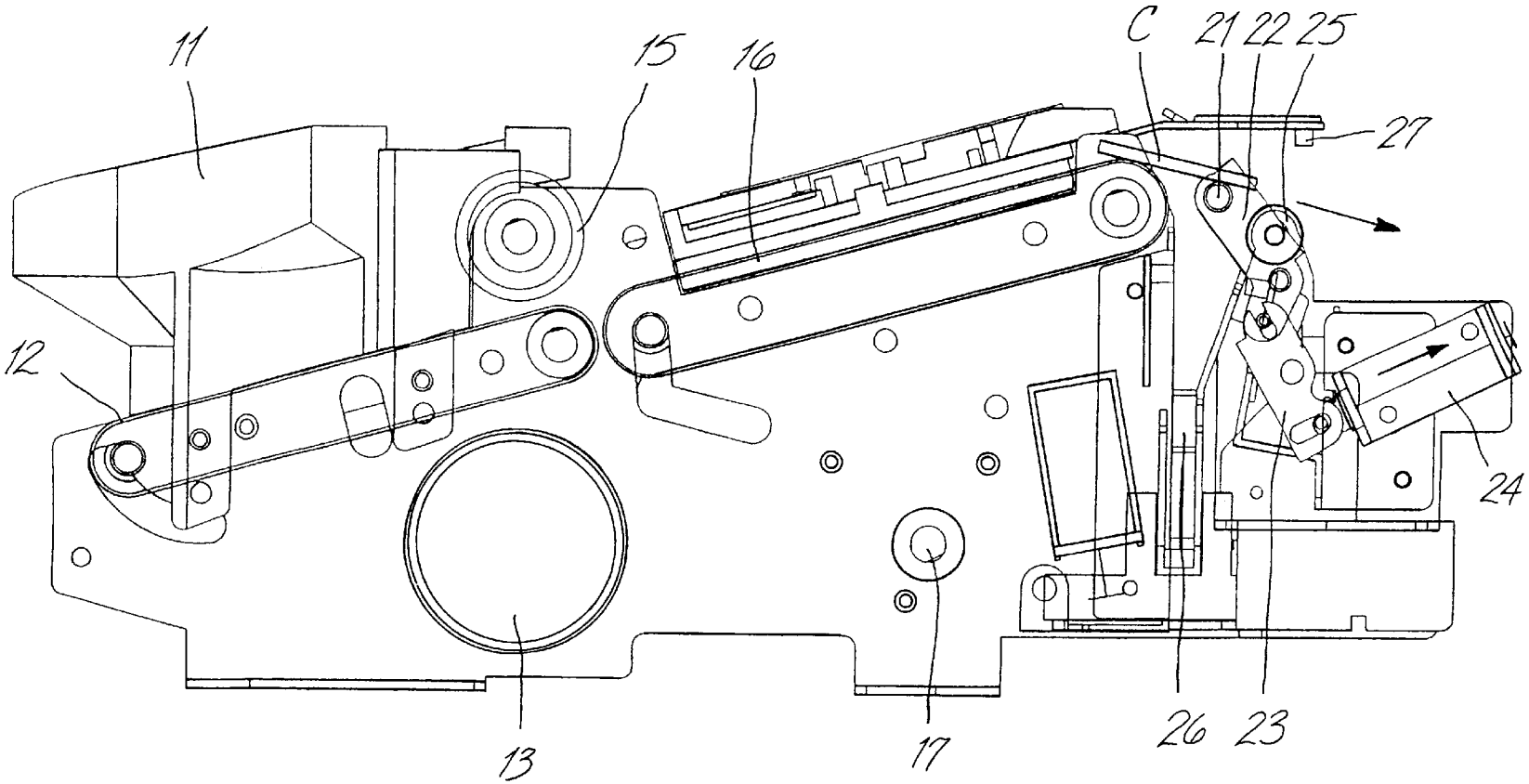
FIG. 3 is a front elevation view showing the usual operating condition of the apparatus of FIG. 2.
Figure 4:
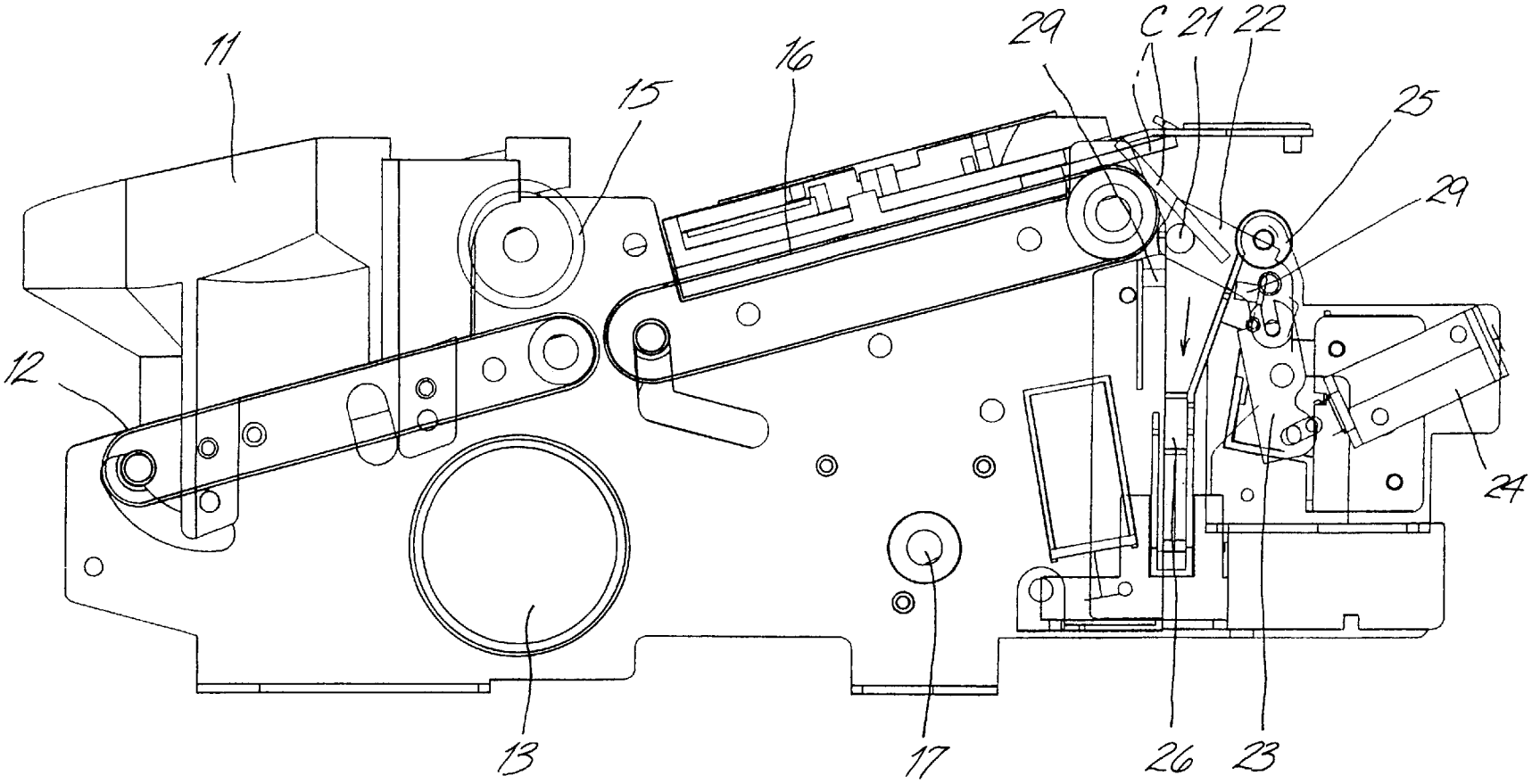
FIG. 4 is a front elevation view showing another operation condition of the apparatus of FIG. 2.

First, a multiple variety of coins are fed into the hopper 11. When the coins are fed into the hopper 11, the movement of the belt 12 is started and the coins will be conveyed in a row by the open edge 11A toward the sending roller 25. With reference to FIG. 3 an authentic coin C which was placed in the hopper 11, is guided in a standing up, on edge condition past the rejection board 26 which has been withdrawn to the selector 20. As shown by the broken lines in FIG. 5, the authentic coin collides with an inclined surface 28 to be directed in a first direction out to the left hand side of the discriminator. If the coin is determined to be counterfeit, as shown in FIG. 4, the rejection board 26 is positioned and the solenoid 24 is actuated to manipulate the link for the sending roller 25 whereupon the counterfeit coin C (FIG. 4) drops to contact the rejection board 26 which directs the counterfeit coin in a second direction such as for collection or the like. After the determined counterfeit coin is rejected, and assuming that the next coin in order is determined to be genuine, the solenoid 24 is actuated to reposition the sending roller 25 to direct the genuine coin in the first direction.

As can be appreciated, the invention can align several kinds of inserted coins and further can distinguish between the authenticity and money type of each coin.

While I have shown and described certain embodiments of the present invention, it is to be understood that it is subject to many modifications and changes not departing from the spirit and scope of the appended claims.

I claim:

1. A coin discriminator apparatus comprising:

a housing having at one end a hopper to receive coins;

a conveyor to convey the coins from the hopper to a coin handling mechanism;

means to singularize the coins on the conveyor;

sensors disposed to sense, for the coins as they are conveyed toward the handling mechanism, at least one physical aspect of each coin to determine one class of coins from another; and said coin handling mechanism including a roller disposed upon a moveable link, said link adapted to position the roller in one of two positions and means for controlling the position of the link, said controlling means positioning the link and roller in a first position for the roller to engage a coin sensed to be of said one class and direct it in said first direction.

2. A coin discriminator apparatus comprising:

a hopper to receive coins;

a conveyor to convey the coins from the hopper to a coin handling mechanism;

means to singularize the coins on the conveyor;

sensors disposed to sense, for the coins as they are conveyed toward the handling mechanism, at least one physical aspect of each coin to determine one class of coins from another; and a roller moveably disposed relative to the conveyor, said roller moveable between one of two positions and means for controlling the position of the roller in response to sensing said at least one physical aspect of each coin, said controlling means positioning the roller in a first position for the roller to engage a coin sensed to be of said one class and direct it in said first direction a coin determined to be of another class in a second direction.

3. The apparatus of claim 2 wherein said conveyor and singularizing means includes a first conveyor disposed to receive coins deposited in said hopper, a roller disposed above the first conveyor to unstack any stacked coins on the first conveyor and a second conveyor disposed to receive the unstacked coins from the first conveyor, said second conveyor adapted to convey the received coins at a speed greater than the speed of the first conveyor to singularize the coins, said coin handling mechanism disposed proximate the end of the second conveyor.

4. The apparatus of claim 2 wherein said sensors are adapted to sense at least one of coin diameter, coin thickness, coin material or perforations in the coin.

5. A coin discriminator comprising:

a hopper into which coins are deposited, the hopper having an open bottom;

a primary belt disposed across the bottom of the hopper to transport coins from the hopper;

a first roller disposed in relating to the primary belt to unstack any coins stacked on the primary belt;

a second belt to receive the coins from the first belt, said second belt moving at a faster speed than the first belt to space the coins;

a sensor disposed near the second belt for detecting the authenticity of a coin being transported;

a moveable second roller;

a solenoid for moving the roller between one of two positions and means for controlling the solenoid to position the roller, said controlling means positioning the roller in a first position for the roller to engage a coin sensed to be of said one class and direct it in a first direction.

* * * * *